US005568011A

United States Patent [19]

Ragland, Jr. et al.

[11] Patent Number: 5,568,011

[45] Date of Patent: Oct. 22, 1996

[54] COLOR PICTURE TUBE FACEPLATE PANEL

[75] Inventors: Frank R. Ragland, Jr.; Stephen T. Opresko, both of Lancaster, Pa.

[73] Assignee: Thomson Consumer Electronics, Inc., Indianapolis, Ind.

[21] Appl. No.: 388,853

[22] Filed: Feb. 15, 1995

[51] Int. Cl.[6] ..... H01J 31/00

[52] U.S. Cl. ..... 313/477 R; 445/22

[58] Field of Search ..... 313/477 R; 445/8–22

[56] References Cited

U.S. PATENT DOCUMENTS

| | | | |
|---|---|---|---|
| 3,381,347 | 5/1968 | Reinwall, Jr. | 445/22 |
| 4,342,942 | 8/1982 | Hockenbrock | 313/477 R |
| 4,498,884 | 2/1985 | Stover et al. | 445/45 |
| 4,535,907 | 8/1985 | Tokita et al. | 220/2.1 A |
| 4,537,322 | 8/1985 | Okada et al. | 220/2.1 A |
| 4,580,077 | 4/1986 | Bakker et al. | 313/477 R |
| 4,591,757 | 5/1986 | Bakker et al. | 313/461 |
| 4,639,636 | 1/1987 | Bakker et al. | 313/408 |
| 4,675,571 | 6/1987 | Bakker et al. | 313/461 |
| 4,723,090 | 2/1988 | Maeda et al. | 313/422 |
| 4,764,706 | 8/1988 | Hinotani et al. | 313/422 |
| 4,808,890 | 2/1989 | Yamazaki | 315/366 |
| 4,943,754 | 7/1990 | Hirai et al. | 313/477 R |
| 4,985,658 | 1/1991 | Canevazzi | 313/477 R |
| 5,107,999 | 4/1992 | Canevazzi | 220/2.1 A |
| 5,447,460 | 9/1995 | Nakamura et al. | 445/22 |

FOREIGN PATENT DOCUMENTS

| | | | |
|---|---|---|---|
| 2151076 | 7/1985 | United Kingdom | 313/477 R |
| 2151074 | 7/1985 | United Kingdom | 313/477 R |

*Primary Examiner*—Alvin E. Oberley
*Assistant Examiner*—Lawrence O. Richardson
*Attorney, Agent, or Firm*—Joseph S. Tripoli; Dennis H. Irlbeck

[57] ABSTRACT

The present invention provides an improvement in a color picture tube. The tube includes an envelope comprising a faceplate panel, a funnel and a neck. The faceplate panel includes a transparent rectangular faceplate having a cathodoluminescent screen on an interior surface thereof, and a peripheral sidewall. The improvement comprises the faceplate panel having either an interior or exterior blend radius from the faceplate to the sidewall that varies around the periphery of the panel in such a manner that the stresses in predetermined areas of the panel are reduced.

4 Claims, 2 Drawing Sheets

Fig. 1
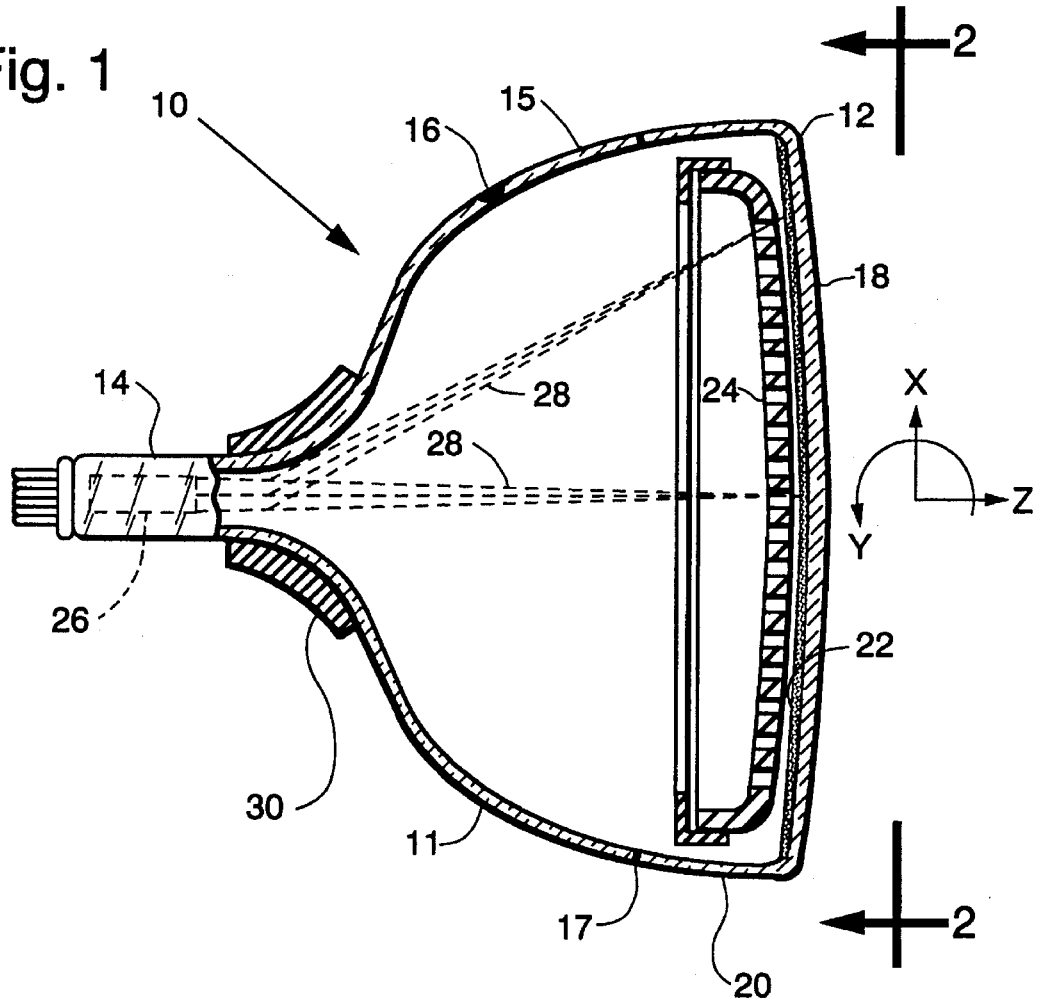
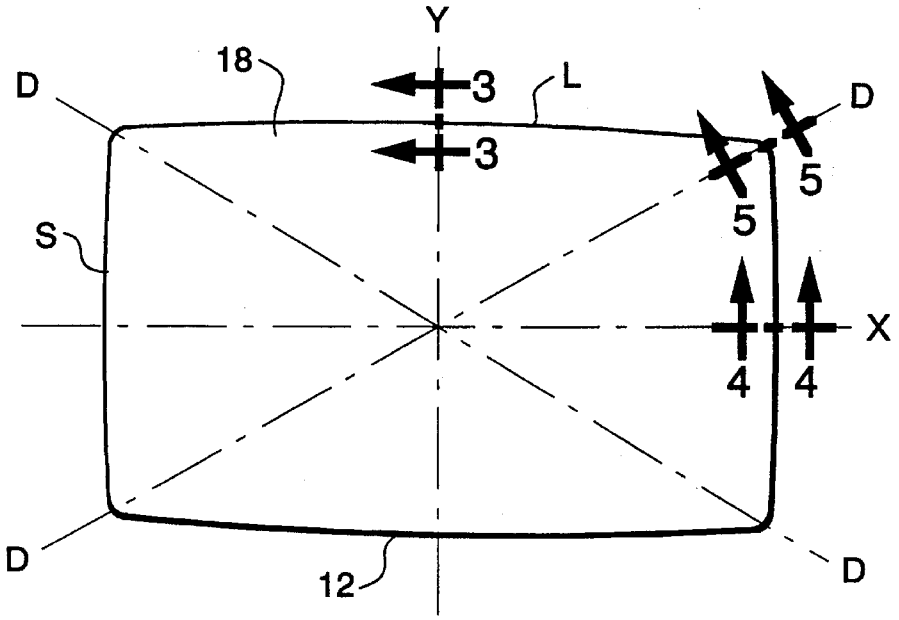
Fig. 2

COLOR PICTURE TUBE FACEPLATE PANEL

This invention relates to color picture tubes and, particularly, to variations in the designs of faceplate panels to achieve increased structural strength by reducing stresses in the panels.

BACKGROUND OF THE INVENTION

A color picture tube has a glass envelope that comprises a neck, a funnel and a faceplate panel. The faceplate panel includes a viewing faceplate that is surrounded by a peripheral sidewall. When the envelope is evacuated, the mechanical stresses in the faceplate panel, caused by vacuum loading, are usually highest at the ends of the major and minor axes, in the interior areas of the panel where the faceplate joins the peripheral sidewall. The juncture of the faceplate and sidewall is usually thick and unyielding. The contour at this juncture is rounded and is commonly referred to as the blend radius.

SUMMARY OF THE INVENTION

The present invention provides an improvement in a color picture tube of a type that includes an envelope comprising a faceplate panel, a funnel and a neck. The faceplate panel includes a transparent rectangular faceplate, having a cathodoluminescent screen on an interior surface thereof, and a sidewall peripherally extending from the faceplate. The improvement comprises the faceplate panel having either an interior or exterior blend radius from the faceplate to the sidewall that varies around the periphery of the panel in such a manner that the stresses in predetermined areas of the panel are reduced.

BRIEF DESCRIPTION OF THE DRAWINGS

FIG. 1 is a side view, partly in axial section, of a color picture tube incorporating one embodiment of the present invention.

FIG. 2 is a plan view of the front of the faceplate panel of the tube of FIG. 1.

DETAILED DESCRIPTION OF THE PREFERRED EMBODIMENTS

Figure 3:
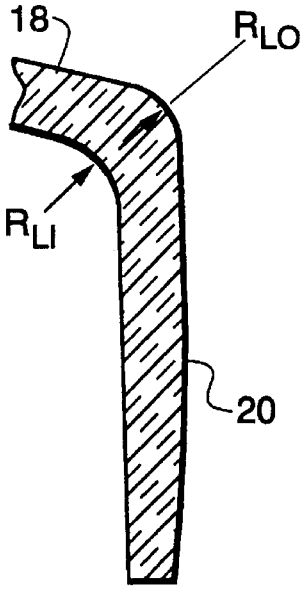
FIG. 3 is a cross-sectional view of the faceplate panel, taken at lines 3—3 of FIG. 2.

FIG. 1 shows a rectangular color picture tube 10 having a glass bulb or envelope 11 comprising a rectangular faceplate panel 12 and a tubular neck 14 connected by a rectangular funnel 15. The funnel 15 has an internal conductive coating (not shown) that extends from an anode button 16 to the neck 14. The panel 12 comprises a transparent rectangular viewing faceplate 18, and a peripheral flange or sidewall 20 which is sealed to the funnel 15 by a glass frit 17. A three-color phosphor screen 22 is carried by the inner surface of the faceplate 18. The screen 22 preferably is a line screen with the phosphor lines arranged in triads, each triad including a phosphor line of each of the three colors. Alternatively, the screen can be a dot screen, and it may or may not include a light-absorbing matrix. A multi-apertured color selection electrode or shadow mask 24 is removably mounted in predetermined spaced relation to the screen 22. An electron gun 26, shown schematically by dashed lines in FIG. 1, is centrally mounted within the neck 14 to generate and direct three electron beams 28 along convergent paths through the mask 24 to the screen 22.

The tube of FIG. 1 is designed to be used with an external magnetic deflection yoke, such as the yoke 30 shown in the neighborhood of the funnel-to-neck junction. When activated, the yoke 30 subjects the three beams 28 to magnetic fields which cause the beams to scan horizontally and vertically in a rectangular raster over the screen 22. The initial plane of deflection (at zero deflection) is at about the middle of the yoke 30.

As shown in FIG. 2, the rectangular faceplate panel 12 includes two centrally located orthogonal axes, a major axis X and a minor axis Y, and two diagonals D that extend corner-to-corner. The two long sides L of the periphery of the faceplate panel 12 substantially parallel the major axis X, and the two short sides S substantially parallel the minor axis Y.

Figure 4:
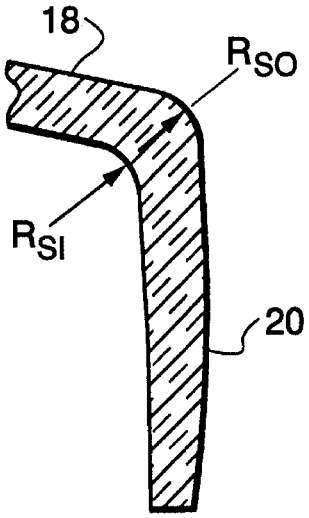
FIG. 4 is a cross-sectional view of the faceplate panel, taken at lines 4—4 of FIG. 2.
Figure 5:
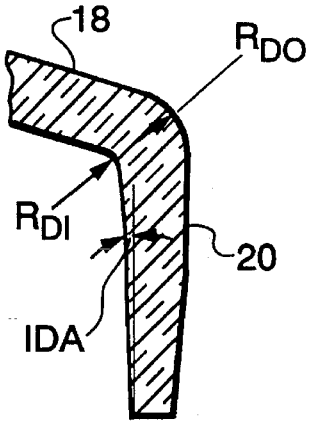
FIG. 5 is a cross-sectional view of the faceplate panel, taken at lines 5—5 of FIG. 2.

FIGS. 3, 4 and 5 show three cross-sections of the panel 12 at the ends of the minor axis Y, major axis X and diagonals D, respectively. In FIG. 3, the interior blend radius between the faceplate 18 and the sidewall 20 is designated $R_{LI}$, and the exterior blend radius is designated $R_{LO}$. In FIG. 4, the interior blend radius is designated $R_{SI}$, and the exterior blend radius is designated $R_{SO}$. In FIG. 5, the interior blend radius is designated $R_{DI}$, and the exterior blend radius is designated $R_{DO}$. In a first preferred embodiment, $R_{LO}=R_{SO}=R_{DO}$ and $R_{LI}>R_{SI}>R_{DI}$. In a second embodiment, $R_{LO}>R_{SO}>R_{DO}$ and $R_{LI}>R_{SI}>R_{DI}$. In a third embodiment, $R_{LO}>R_{SO}>R_{DO}$ and $R_{LI}=R_{SI}=R_{DI}$. In a fourth embodiment, $R_{LO}=R_{SO}>R_{DO}$ and $R_{LI}>R_{SI}>R_{DI}$. In a fifth embodiment, $R_{LO}=R_{SO}>R_{DO}$ and $R_{LI}>R_{SI}=R_{DI}$. In all of these embodiments, either the interior blend radii, the exterior blend radii, or both the interior and exterior blend radii are varied around the periphery of the faceplate panel.

In a preferred embodiment, the interior blend radius, R, at various locations around the periphery of the faceplate panel can be calculated using the equation:

$$R_I=a\cdot Z^i+k,$$

where Z is the sagittal height with respect to the faceplate center, and a, i and k are constants that are used to define the blend radius along the long and short sides that result in different blend radii at the ends of the major and minor axes. The following Table presents an embodiment using the above equation for an interior blend radius $R_I$, wherein the given values of X and Y represent the coordinates at the ends of the major and minor axes. All dimensions are in centimeters (inches).

TABLE

| | MINOR | DIAGONAL | MAJOR |
|---|---|---|---|
| X = | 0.00 | 26.34 (10.37) | 26.67 (10.50) |
| Y = | 20.17 (7.94) | 19.76 (7.78) | 0.00 |
| Z = | 1.98 (0.78) | 5.38 (2.12) | 3.51 (1.38) |
| $R_I$ = | 1.59 (0.625) | 0.32 (0.125) | 1.11 (0.438) |

TABLE-continued

| MINOR | DIAGONAL | MAJOR |
|---|---|---|

a = −0.472 (−0.1860)
i = 4.095 (1.6123)
k = 1.905 (0.750)

There are many other ways of defining changes in the blend radius, but any method selected should result in a smooth transition at the ends of the axes. The table above only shows the blend radii at the ends of major and minor axes and at the ends of the diagonals. The X, Y locations along the sides are determined by the active screen, the required bezel border around the screen, the panel sidewall, strength considerations and other factors involved in panel design. This method allows the panel radius to start at the screen edge and blend with the panel sidewall. Such method may be applied to both the inside and outside of the panel.

The embodiment given in the preceding Table can be compared with a prior art embodiment. The interior blend radius at the corners, $R_{DI}$, of a similar size prior art tube is 1.9 cm (0.75 inch), whereas the interior blend radius of the improved embodiment is 0.32 cm (0.125 inch). The interior blend radius at the ends of the major axis, $R_{SI}$, of the prior art tube is 1.4 cm (0.550 inch), which compares to a radius of 1.11 cm (0.438 inch) for the improved embodiment. Preferrably, it is desirable to make the longest interior blend radius at least twice as long as the shortest interior blend radius.

GENERAL CONSIDERATIONS

In embodiments of the present invention, either the internal blend radii, external blend radii or both the internal and external blend radii are varied from the prior art to modify the stresses in a faceplate panel. In particular, it is desirable to reduce the highest tensile stresses that occur in a faceplate panel. These stresses have been found to be greatest on the exterior surface of a tube faceplate panel at the ends of the minor axis at the ends of the major axis. With one embodiment of the present invention, the peak tensile stresses on the exterior surface of the faceplate panel are reduced by increasing the exterior blend radii at the ends of the minor and major axes. In another embodiment of the present invention, the peak tensile stresses on the interior surface of a faceplate panel are reduced by decreasing the interior blend radii at the corners. Both increasing the exterior blend radius and decreasing the interior blend radius at a particular panel location produces a thinner section at the faceplate-sidewall junction. This thinning allows a change in the bending of the panel that at least partially relieves the stresses that occur in the panel during and after picture tube processing. Furthermore, the thinning of the panel glass at the faceplate-sidewall junction also permits a more stable thermal distribution in the panel during various processing steps wherein heat is added to the panel.

Figure 6:
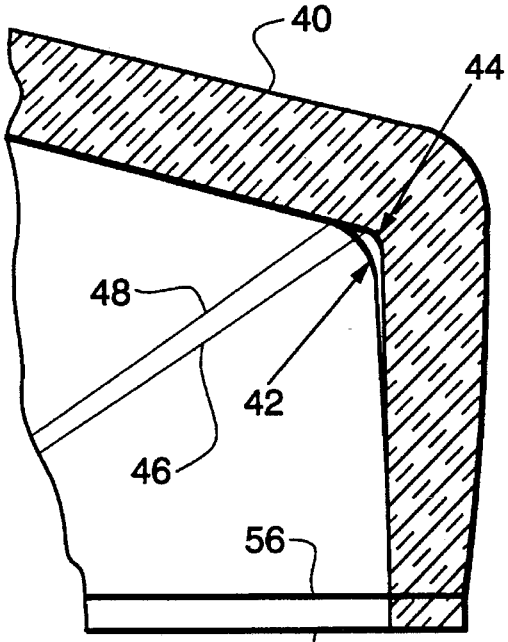
FIG. 6 is a cross-sectional view at a corner of a faceplate panel.
Figure 7:
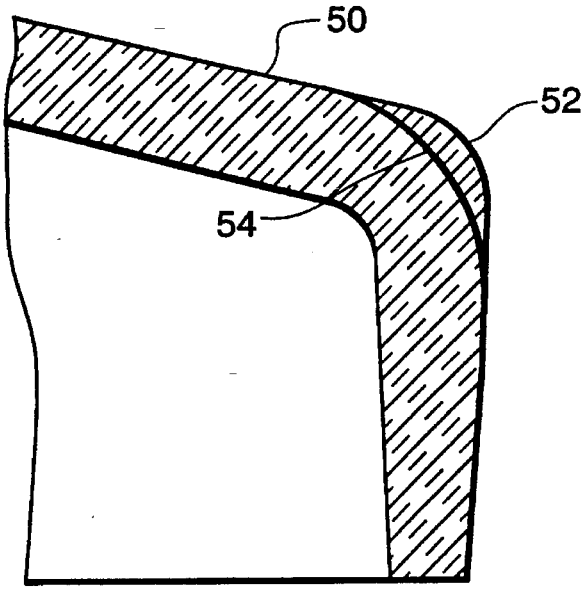
FIG. 7 is a cross-sectional view at a corner of another faceplate panel.

FIGS. 6 and 7 show two versions of faceplate panels that use different aspects of the present invention. In FIG. 6 the interior blend radius at the end of a diagonal of a faceplate panel 40 is shown as being reduced from a contour designated 42 to an improved contour designated 44. Another advantage of contour 44 over contour 42 is that the corners of a viewing screen may be stretched as indicated by maximum deflected electron beams 46 and 48, respectively. In FIG. 7, the exterior blend radius of a faceplate panel 50 is increased to change the periphery from an original contour 52 to an improved contour 54.

The changes in blend radii can also be combined with other changes in the design of faceplate panels to further reduce stresses in the panels and to increase the size of the viewing screen portion of the faceplate. One of these changes involves the draft angle of a faceplate panel skirt. The draft angle is an angle on the inside of the panel skirt which is required for manufacture of the panel. The interior draft angle, IDA in FIG. 5, on a skirt along the diagonal can be a single angle or a compound angle. Typically, when a single angle is used, the angle is kept between 6 degrees and 0.5 degree. Draft angles smaller than 0.5 degree are impractical for glass manufacture. For each 2.54 cm (one inch) of skirt height, the draft angle increases 0.5 degree, alternatively, as the skirt height increases, a compound angle can be used to vary draft angle. A typical compound angle for a 66 cm (26- inch) diagonal tube, is 3 degrees starting at the panel seal land and changing to 6.5 degrees at about 3.8 cm (1.5 inches) up the skirt. Such compound angles can also be used on the major and minor axes. The changes in blend radii and interior draft angle can also be combined with an increase in skirt length or height. Such a change in skirt height is shown in FIG. 6 by a change in the seal edge of the panel 40 from 56 to 58. An increase in skirt height serves at least two purposes. First, the beam angle from the electron gun is kept unchanged and keeps the electron beams at the proper distance from the funnel and, second, the stress levels on the panel are reduced and the effect of the reduction in interior blend radius on panel stress levels is reduced.

We claim:

1. In a color picture tube including an envelope comprising a faceplate panel, a funnel and a neck, said faceplate panel including a transparent rectangular faceplate having a cathodoluminescent screen on an interior surface thereof and a peripheral sidewall, said faceplate panel having two long sides, two short sides and four corners, and a minor axis of said panel passing through the center of said panel and paralleling said two short sides, the improvement comprising said faceplate panel having an interior blend radius from said faceplate to said sidewall that varies around the periphery of said panel, wherein the interior blend radius at each of the corners of said panel is the shortest interior blend radius, the interior blend radius at each of the ends of the minor axis is the longest interior blend radius, and the length of the interior blend radius at each of the ends of the major axis is between the lengths of the longest and shortest interior blend radii.

2. The tube as defined in claim 1 wherein the longest interior blend radius is at least twice as long as is the shortest interior blend radius.

3. In a color picture tube including an envelope comprising a faceplate panel, a funnel and a neck, said faceplate panel including a transparent rectangular faceplate having a cathodoluminescent screen on an interior surface thereof and a peripheral sidewall, the improvement comprising said faceplate panel having an exterior blend radius from said faceplate to said sidewall that varies around the periphery of said panel.

4. In a color picture tube including an envelope comprising a faceplate panel, a funnel and a neck, said faceplate panel including a transparent rectangular faceplate having a cathodoluminescent screen on an interior surface thereof and a peripheral sidewall, the improvement comprising said faceplate panel having an interior blend radius and an exterior blend radius, from said faceplate to said sidewall, that both vary around the periphery of said panel.

* * * * *